US008359762B1

(12) United States Patent
Blasi

(10) Patent No.: US 8,359,762 B1
(45) Date of Patent: Jan. 29, 2013

(54) WALL SIDING BOARD INSTALLATION TOOL

(76) Inventor: Rodney Blasi, Wichita, KS (US)

( * ) Notice: Subject to any disclaimer, the term of this patent is extended or adjusted under 35 U.S.C. 154(b) by 272 days.

(21) Appl. No.: 12/971,665

(22) Filed: Dec. 17, 2010

(51) Int. Cl.
*G01D 21/00* (2006.01)

(52) U.S. Cl. ..... 33/646

(58) Field of Classification Search ..... 33/626, 33/646, 647, 648, 649
See application file for complete search history.

(56) References Cited

U.S. PATENT DOCUMENTS

| | | | | |
|---|---|---|---|---|
| 97,436 | A | 11/1869 | Pedrick | |
| 102,649 | A * | 5/1870 | Biiddleboom | 33/646 |
| 298,682 | A | 5/1884 | Finch | |
| 1,031,854 | A | 7/1912 | Keyes | |
| 1,097,146 | A | 5/1914 | Snyder | |
| 1,115,202 | A * | 10/1914 | Ingles | 33/646 |
| 3,490,152 | A * | 1/1970 | Printz | 33/649 |
| 4,314,429 | A | 2/1982 | Casteel et al. | |
| 4,425,714 | A | 1/1984 | Kelly, Jr. | |
| 4,484,392 | A * | 11/1984 | DeFino et al. | 33/647 |
| 4,654,975 | A | 4/1987 | Lopez | |
| D334,892 | S | 4/1993 | Jenkins | |
| 5,465,499 | A * | 11/1995 | LaPlante | 33/647 |
| 5,623,767 | A | 4/1997 | Colavito | |
| 5,692,311 | A | 12/1997 | Paquin | |
| 6,367,160 | B1 | 4/2002 | Rempe | |
| 7,124,551 | B1 | 10/2006 | Patera | |
| 7,168,181 | B2 | 1/2007 | Walchak | |
| 7,213,346 | B1 | 5/2007 | Gregory | |
| 7,275,333 | B1 | 10/2007 | Neuroth | |
| 7,694,429 | B2 * | 4/2010 | Duquette et al. | 33/647 |
| 2004/0237461 | A1 | 12/2004 | Edwards et al. | |
| 2006/0196070 | A1 * | 9/2006 | Walchak | 33/647 |
| 2009/0107084 | A1 | 4/2009 | Hutchings | |

FOREIGN PATENT DOCUMENTS

| | | |
|---|---|---|
| CA | 2588719 | 11/2008 |

* cited by examiner

*Primary Examiner* — G. Bradley Bennett
(74) *Attorney, Agent, or Firm* — Kenneth H. Jack; Davis & Jack, LLC

(57) ABSTRACT

A wall siding board installation tool including a quill and shaft assembly having upper ends; a board top hooking member and a board bottom hooking member, the board top and bottom hooking members defining an "S" hook; the board top hooking member being fixedly attached to an upper end selected from the group consisting of the quill upper end and the shaft upper end, the board bottom hooking member being fixedly attached to the other upper end; and an "S" hook extending and retracting lever and actuator arm assembly connected operatively to the quill and shaft assembly, the lever and actuator arm assembly being adapted for moving the quill or the shaft between a board suspending position and a tool releasing position, the board top and bottom hooking members being displaced a calibrated lap joint distance away from each other upon movement to the suspending position.

14 Claims, 5 Drawing Sheets

WALL SIDING BOARD INSTALLATION TOOL

FIELD OF THE INVENTION

This invention relates to wall siding boards, and tools adapted for assisting construction work persons in installing siding boards upon the walls of building structures. More particularly, this invention relates to such tools which are adapted for holding wall siding boards in place and at a proper position during application of siding board fasteners.

BACKGROUND OF THE INVENTION

"S" hooks are known to be advantageously utilized for assistance in installation of lap jointed or clinker built wall siding boards. In use of such "S" hooks, a construction work person may install an "S" hook over an upper edge of an installed siding board. Thereafter, the "S" hook may be utilized for correctly holding and positioning a successively installed and upwardly overlying wall siding board. Upon such holding and positioning of such next installed board, the construction worker may fasten such board in place. At such point, the construction worker typically desires to remove the "S" hook for use in positioning and holding a next successive and overlying wall siding board. However, such "S" hooks tend to be captured through their engagement with underlying boards, making it difficult for the construction worker to remove the "S" hook.

The instant inventive wall siding board installation tool solves or ameliorates the problems, deficits, and defects noted above by providing a specially adapted and configured "S" hook board suspending tool which is capable of easily and conveniently releasing boards following board suspending use.

BRIEF SUMMARY OF THE INVENTION

A first structural component of the instant inventive wall siding board installation tool comprises a quill and shaft assembly. In the preferred embodiment, both the quill and the shaft components of the assembly are composed of durable metal, and the quill component preferably forms and defines a slide channel within which the shaft component is slidably installed. Further structural components of the instant tool comprise board top edge and board bottom edge hooking means, such means together defining an "S" hook capable of receiving, guiding, and positioning top and bottom edges of lap jointed or clinker built wall siding boards. In a suitable embodiment, the board top edge hooking means are fixedly attached to an upper end structure selected from the group consisting of the quill's upper end and the shaft's upper end. Also in such embodiment, the board bottom edge hooking means are fixedly attached to whichever upper end among said group lends no support to the board top edge hooking means.

A further structural component of the instant inventive wall siding board installation tool comprises first "S" hook extending and retracting means, such means preferably being operatively connected to the quill and shaft assembly. In the preferred embodiment, the first "S" hook extending and retracting means are adapted for moving the quill or shaft (such motion being dependent upon a mechanical design choice wherein one or the other member of the quill and shaft assembly is adapted for motion with respect to the other) between first and second positions or board suspending and tool releasing positions. In order to allow the inventive tool to properly position and overlap installed siding boards, the board top edge and board bottom edge hooking means are preferably normally vertically displaced away from each other a calibrated or measured lap joint distance. Accordingly, movement of the quill or shaft (as the case may be) which places the hooking means a lap joint distance away from each other constitutes movement to the first position or the board suspending position. In practice, such calibrated lap joint distance is between one and two and one-half inches. In the preferred embodiment, the board top edge and board bottom edge hooking means are adapted for further vertical displacement away from each other upon movement of the quill or the shaft (as the case may be) to the tool releasing position. Such further displacement is preferably dependent upon and related to the depth of the valley or concavity of the board top edge hooking means, the excess displacement preferably allowing for extending movement of the "S" hook a distance allowing for extraction without mechanical interference of a siding board top edge from such valley.

A further preferred structural component of the instant inventive wall siding board installation tool comprises a biasing means which operatively interconnect the quill and the shaft components. In the preferred embodiment, the biasing means are adapted for normally moving the quill or the shaft (as the case may be) to the board suspending position. Preferably, the biasing means are capable of exerting an upwardly directed force against a board bottom edge sufficient to prevent the weight of the wall siding board from vertically displacing the board top edge and board bottom edge hooking means away from each other. In the preferred embodiment, the biasing means may comprise a helical spring. Suitably, other biasing means such as elastic bands, elastic pieces or inserts, or pivoting counter weights may be substituted for the preferred biasing spring.

The first "S" hook extending and retracting means preferably comprise a lever, pivot, or fulcrum, and actuator arm assembly which is connected operatively to the quill or to the shaft (as the case may be). Where the shaft component of the quill and shaft assembly is chosen as the relatively moveable element, a distal end of the actuator arm may be suitably linked to the shaft while the pivot or fulcrum component is fixedly anchored upon in relation to the assembly's quill component. In such assembly, actuation of the lever advantageously vertically drives or moves the shaft in relation to the quill and against the biasing means, such motion moving the shaft toward its tool releasing position. Alternatively, such lever, pivot, and actuator arm assembly may be mounted for imposing movement of the quill component toward a tool releasing position in relation to the shaft. Other commonly known linear motion actuating assemblies such as pull cable and pulley assemblies are considered to fall within the scope of the "S" hook extending and retracting means.

A further preferred component of the instant inventive tool comprises a handle which is mounted for convenient and ergonomic wielding of the "S" hook components. In the preferred embodiment, the handle extends rearwardly from and is rigidly mounted upon the quill or the shaft, such rigid mounting being dependent upon the selection of the quill and shaft assembly's relatively moveable element. Also in the preferred embodiment, the handle is positioned for ergonomically facilitating finger engagement with and actuation of the first "S" hook's extending and retracting means' lever, or other actuator element where another linear motion actuating assembly is provided.

In the construction industry arts, wall siding boards are known to be overlapped or lap jointed at various overlapping distances between one and two and one-half inches. In order to allow the instant inventive tool to accommodate such practice, a preferred embodiment of the tool incorporates second "S" hook extending and retracting means which are connected operatively either to the quill or to the shaft of the assembly. In the preferred embodiment, the second "S" hook extending and retracting means are adapted for facilitating selective adjustment of the calibrated lap joint distance between the board top edge and board bottom edge hooking means. In a suitable embodiment, the second "S" hook extending and retracting means may comprise a board supporting slide block, and releasable slide block fastening means combination, such means suitably comprising a set screw and slide channel which enables the slide block to be selectively vertically positioned in relation to the quill or to the shaft. Where an upper surface of such slide block is positioned for service as a valley floor of the board bottom edge hooking means, such block's capacity for selective vertical positioning may advantageously adjust the tool's calibrated lap joint distance.

In use of the instant inventive wall siding board installation tool, the construction worker may initially engage the tool's board top edge hooking means with a siding board which has been installed upon the wall of a building structure. Thereafter, the construction worker may place a next successively installed wall siding board in engagement with the tool such that the next successive board's bottom edge engages with the tool's board bottom edge hooking means. In the event that two renditions of the instant inventive tool are provided, such construction worker may utilize such second tool for similarly engaging and holding an opposite end of such next successive board. Thereafter, the construction worker may fasten the upper edge of such next successive board to the wall. Thereafter, the construction worker may actuate the tool's first "S" hook extending and retracting means, providing for extracting clearances of the board edges from the board top edge and board bottom edge hooking means. Accordingly, upon such extending and retracting means actuation, the construction worker may easily and conveniently disengage the tool from the installed boards, and may utilize the tool for assistance in installation of a next successive and overlying wall siding board.

Accordingly, objects of the instant invention include the provision of a wall siding board installation tool which incorporates structures, as described above, and which arranges those structures in manners described above for performance of beneficial functions, as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
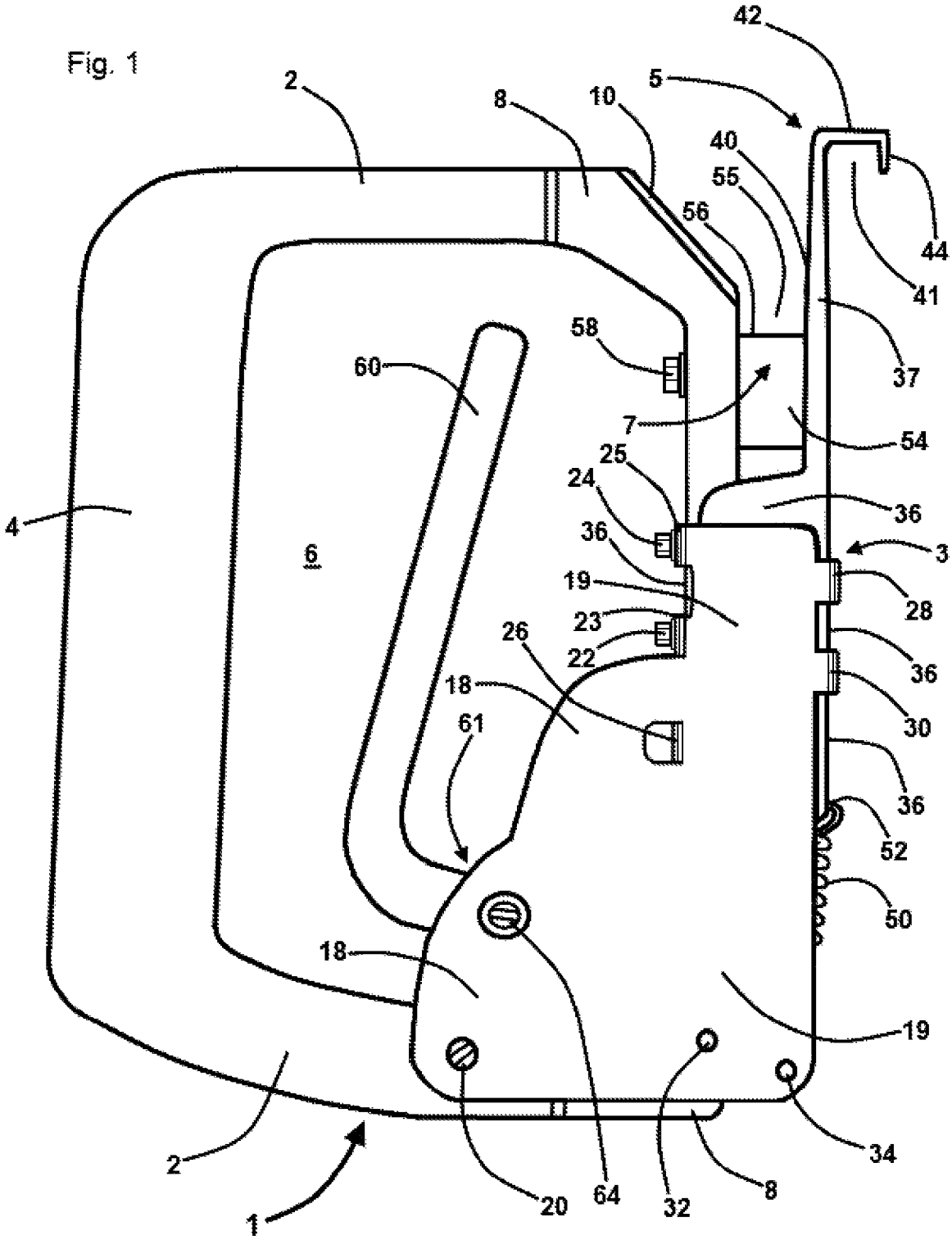
FIG. 1 is a side view of a preferred embodiment of the instant inventive wall siding board installation tool.
Figure 2:
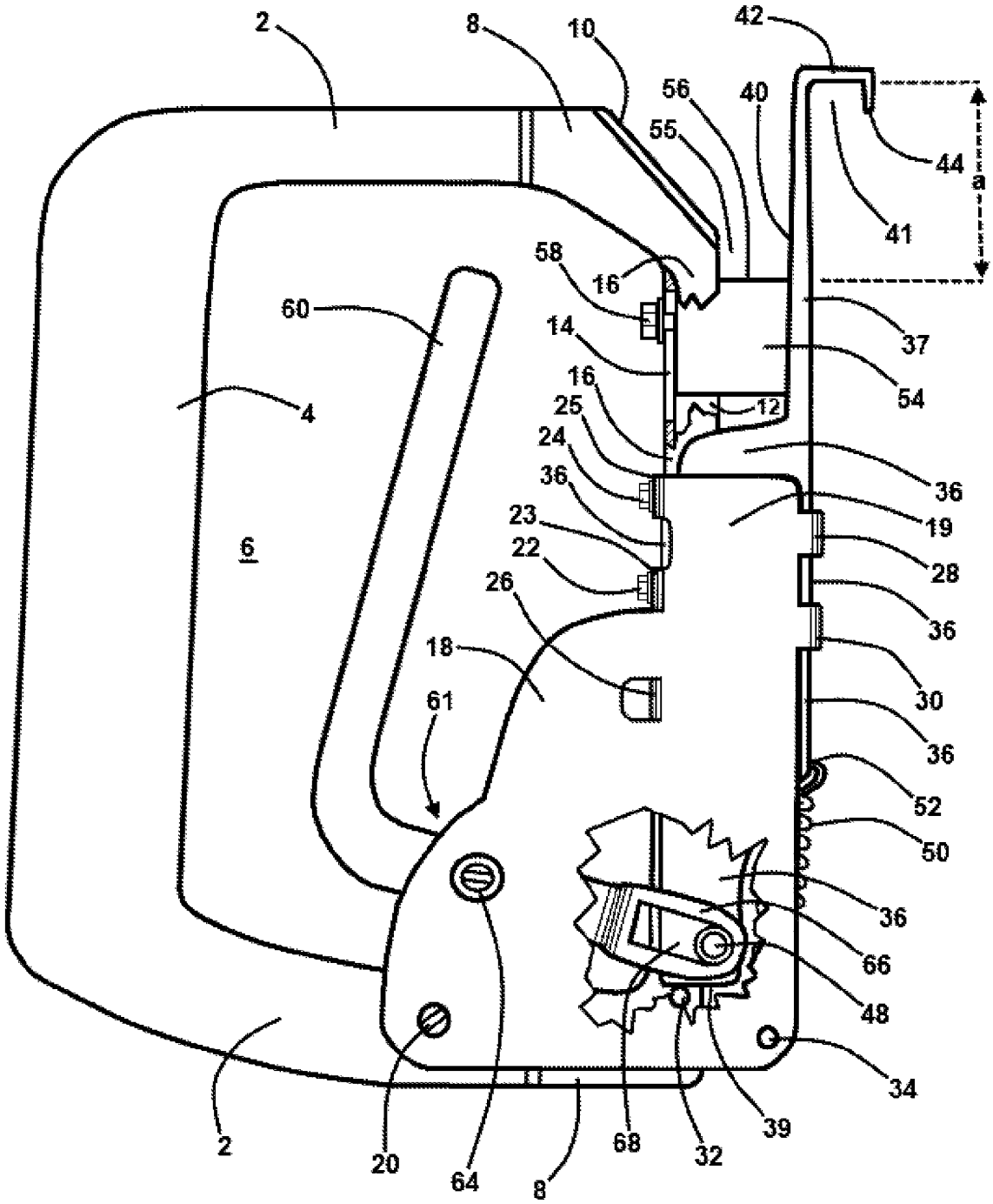
FIG. 2 redepicts the tool of FIG. 1, the view of FIG. 2 including "cutaway" sections exposing and explaining underlying structures.

Referring now to the drawings, and in particular to Drawing FIGS. 1 and 2, a preferred embodiment of the instant inventive wall siding board installation tool is referred to generally by Reference Arrow 1. The tool 1 preferably comprises a quill and shaft assembly which is referred to generally by Reference Arrow 3. Such assembly 3 may suitably comprise a quill 19 which envelopes (either partially or wholly), receives, and forms, and defines a slide channel within which shaft component 36 is mounted. Structures of the quill 19 component may include a right side wall, as depicted in FIGS. 1 and 2, an opposite left side wall (not depicted within views), and front and rear retainer loops or tabs 28, 30, 25, 26, and 23. In the tool configuration depicted in FIGS. 1 and 2, the quill component 19, 28, 30, 25, 26, and 23 is rigidly mounted with respect to handle 4, while the assembly's shaft component 36 is relatively vertically slidably moveable. In a suitable alternative configuration (not depicted within views), the shaft component may be configured to be relatively sessile, while the quill component is vertically, slidably moveable.

Referring to FIG. 1, the instant inventive tool preferably further comprises board top edge hooking means which are referred to generally by Reference Arrow 5, such means suitably comprising a forwardly extending member 42 and a downwardly extending and tapered tang 44, the upper end of tang 44 being fixedly attached to or formed wholly with the distal or forward end of member 42. The tang 44 in combination with member 42 and in combination a wholly formed or fixedly attached suspension tie 37 advantageously forms and defines a downwardly opening valley 41. In the preferred embodiment, the valley 41 is fitted for receiving and hookingly engaging top edges of common wall siding boards.

Referring simultaneously to FIGS. 1 and 2, the instant inventive tool preferably further comprises board bottom edge hooking means which are referred to generally by Reference Arrow 7, such means comprising an upper surface 56 of a preferably selectively moveable and fixable slide block 54. Further components of the board bottom edge hooking means 7 may comprise the rearward face or surface of suspension tie 37 in combination with a forward face of a vertically extending member 16. In compliment with the downwardly opening valley 41 of the board top edge hooking means 5, the board bottom edge hooking means 7 forms and defines an upwardly opening valley 55. Just as the downwardly opening valley 41 is fitted for receiving top edges of commonly sized wall siding boards, the upwardly opening valley 55 is fitted for receiving bottom edges of such boards. The upper surface 56 of the slide block 54 in combination with components including the suspension tie 37, the forwardly extending member 42, and the tang 44 advantageously form and define and "S" hook which is capable of, referring further to FIG. 4, supporting and positioning an overlying wall siding board 106 with respect to a previously installed underlying wall siding board 102.

In the exemplary configuration of FIGS. 1 and 2, it may be seen that the board top edge hooking means 5 is fixedly (and therefore moveably) attached to the upper end of shaft member 36, while the board bottom edge hooking means is fixedly and relatively immovably attached (via mechanical links including screws and loops 22, 23, 24, and 25, forward frame member 16 and set screw 56) to the quill member 19. However, alternative structures substituting for the board top edge hooking means may be alternatively mounted to a quill upper end where the quill upper end is selected to be the relatively moveable member of the quill and shaft assembly. Upon such alternative mounting and positioning of the board top edge hooking means, structure substituting for the board bottom edge hooking means 7 are necessarily mounted upon the other upper end of such alternative quill and shaft assembly, such other upper end residing at the upper end of such assembly's shaft. Further alternatively, the board bottom edge hooking may constitute the "S" hook component which is adapted for relative mechanical movement and, like the board top edge hooking means, such alternatively moveable board bottom edge hooking means may be mounted either to a moveable quill component or to a moveable shaft component.

Referring further to FIGS. 1 and 2, the instant inventive wall siding board installation tool preferably further comprises at least first "S" hook extending and retracting means, such means being referred to generally by Reference Arrow 61. The "S" hook extending and retracting means 61 preferably comprise a lever 60 and an actuator arm 62 assembly, the lever 60 and actuator arm 62 being mounted upon a laterally extending pivot pin 64, such pin 64 serving as a fulcrum. In the exemplary embodiment, the left and right side walls of the quill 19 form and define left and right clevis ears 18, such left and right clevis ears 18 receiving the lever 60 and actuator arm 62 and supporting the laterally extending pivot pin 64. The actuator arm 62 may operatively engage the lower end of the quill and shaft assembly's slide shaft 36 by means of a forwardly opening clevis bracket 66 which captures leftwardly and rightwardly extending carry pins 48 within left and right travel slots 68. In the depicted embodiment, the slide shaft 36 forms a rearwardly opening "C" channel which nestingly and slidably receives the vertical frame member 16, while the clevis 66 of the actuator arm 62 oppositely nestingly receives both the frame member 16 and the rearwardly opening "C" channel 36. Forward handle extensions 2 in combination with handle 4 and forward frame member 16 preferably present laterally thinned or inset forward sections 8, such sections 8 providing dimensional clearance for the nesting receipts of structures within channels and clevises, as described above.

For enhanced structural rigidity, the tool's frame including handle 4, upper and lower forward extensions 2, the forward sections 8, and the vertically extending section 16, form an "O" configured frame, such frame defining an inferior space 6. In the depicted embodiment, the quill component 19 is fixedly and rigidly mounted to such "O" frame by means of the screws 22 and 24, and by means of screws 20.

Referring simultaneously to FIGS. 1 and 2, biasing means in the form of a spring 50 are preferably provided, such spring 50 preferably having its lower end fixedly attached to a laterally extending bar 34, and having its upper end fixedly attached within a forwardly opening eye 52 positioned at a lower lip of the slide shaft 36. The spring 50 preferably operates to normally downwardly slidably move the slide shaft 36 within the channel of quill 19 until the lower end 39 of the slide shaft 36 impinges against and is stopped by a laterally extending slide stop bar 32. Upon such spring biased movement of the slide shaft 36 to the stopped position depicted in FIG. 2, the slide shaft 36 is advantageously positioned at a relative elevation where the vertical distance between or displacement of the hooking means 5 and 7 equals a calibrated siding board lap joint installation distance.

Figure 3:
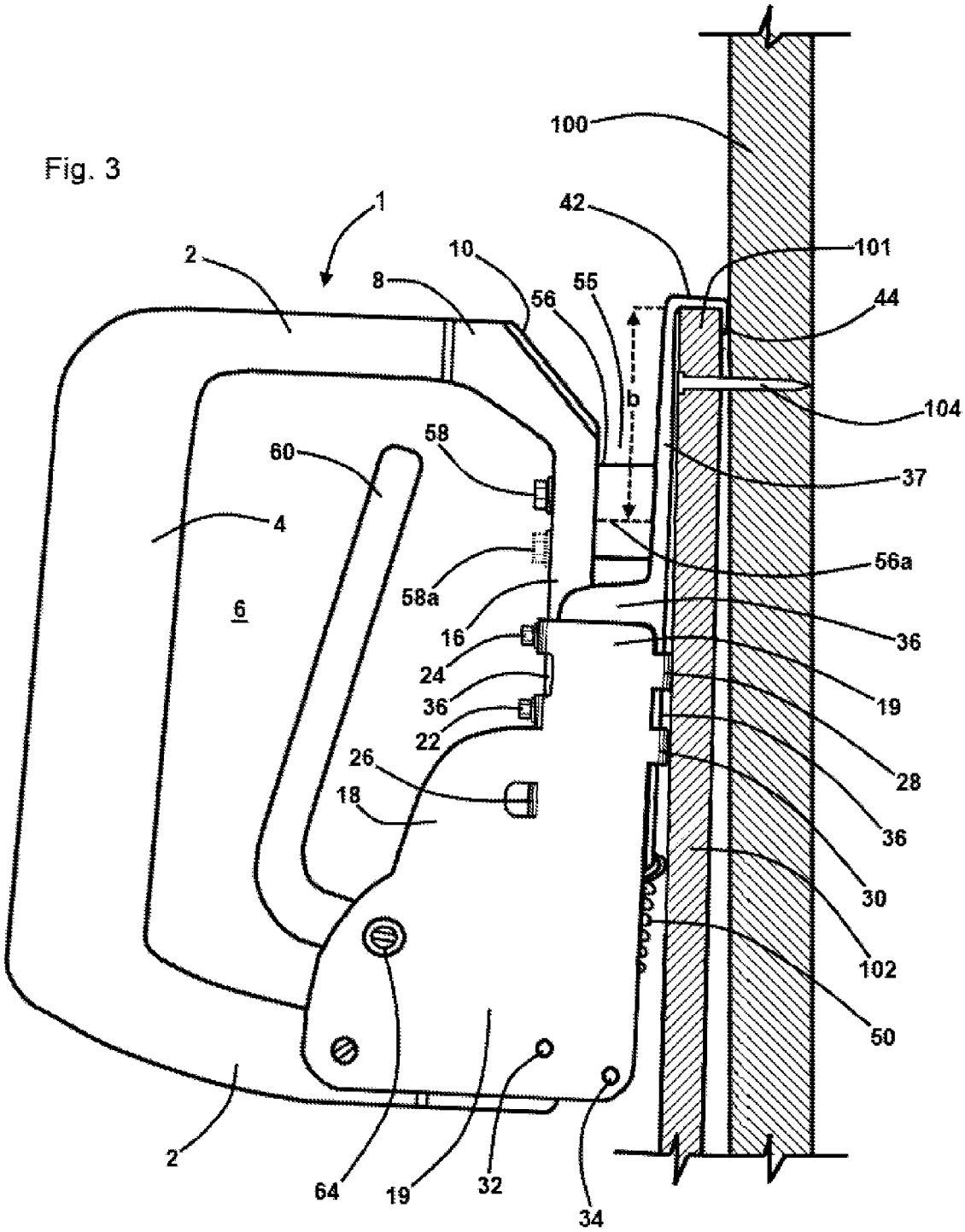
FIG. 3 redepicts the tool of FIG. 1, the view showing the tool's engagement with a siding board top edge.

Referring simultaneously to FIGS. 1 and 2, second "S" hook extending and retracting means are preferably provided, such means suitably comprising a slidable and adjustable mount of the slide block 54 within a forwardly opening slide channel 12, such channel being formed within vertical frame member 16. The forward end of the slide block 54 may be further slidably mounted within a rearwardly opening slide channel 40 formed within suspension tie 37. The forwardly opening slide channel 12 preferably further opens rearwardly at a screw receiving travel slot 14. Upon extension of screw 58 through such travel slot 14, and upon tightened threaded engagement of such screw 58, with a helically threaded socket within the rearward face of slide block 54, the slide block 54 may effectively be selectively positioned with respect to the board top edge receiving valley 41. Referring further to FIG. 3, such second "S" hook extending and retracting means may be effectively manipulated by loosening screw 58 and by slidably moving the slide block 54 downwardly along travel slot 14 until the upper surface 56 newly resides at the downwardly displaced position denoted by dashed line **56*a*. Thereafter, the screw 58 may be re-tightened at screw position 58*a*. Such second "S" hook extending and retracting means manipulation may advantageously alter the calibrated lap joint distance of the tool from the distance a, as denoted upon FIG. 2, to the distance b, as denoted on FIG. 3**.

In use of the instant inventive tool 1, referring to FIG. 3, a user may initially grasp handle 4 and may extend the tool 1 toward the top edge 101 of a horizontally extending wall siding board 102, such board 102 having been previously installed upon wall siding underlayment or wall stud 100 by means of nails 104. Thereafter, the user may extend the tapered tang 44 into the seam between board upper end 101 of board 102 and underlayment 100, such tang extension causing the board upper edge 101 to reside and to be effectively captured within, referring further simultaneously to FIG. 1, the downwardly opening valley 41 of the board top edge hooking means 5. Thereafter, the user may release his or her grasp of handle 4, allowing the tool 1 to hang from and serve as a board suspending "S" hook at the upper edge 101 of wall board 102.

Figure 4:
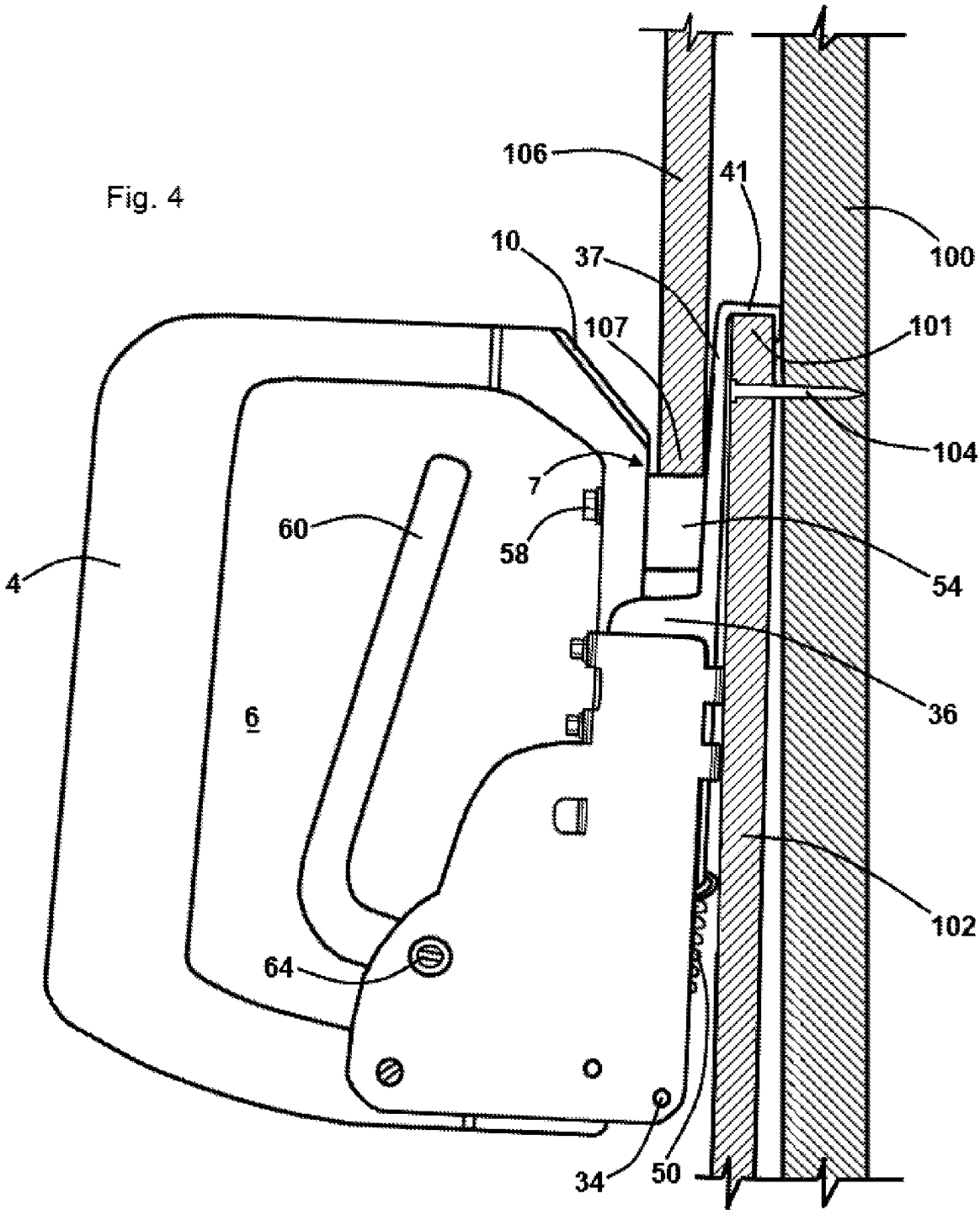
FIG. 4 redepicts FIG. 3, the view of FIG. 4 further showing the tool's engagement with a bottom edge of a successively installed and overlying wall siding board.

Thereafter, referring simultaneously to FIGS. 3 and 4, the user may place a next successive and overlying wall siding board 106 within the "S" hook so that such board's bottom edge 107 resides within and is captured by the upwardly opening valley 55 of the board bottom edge hooking means 7. Preferably, the upper forward end of the tool's "O" frame has a chamfered and reinforced edge 10, such chamfered edge 10 assisting in slidably guiding board bottom edge 107 into the upwardly opening valley 55. Upon such valley's receipt of the board 106, the "S" hook bears its weight without downward deflection via the tension of spring 50. Thereafter, such user may securely fasten board 106 to wall underlayment 100 in the same manner as the nail fastened attachment of board 102.

Figure 5:
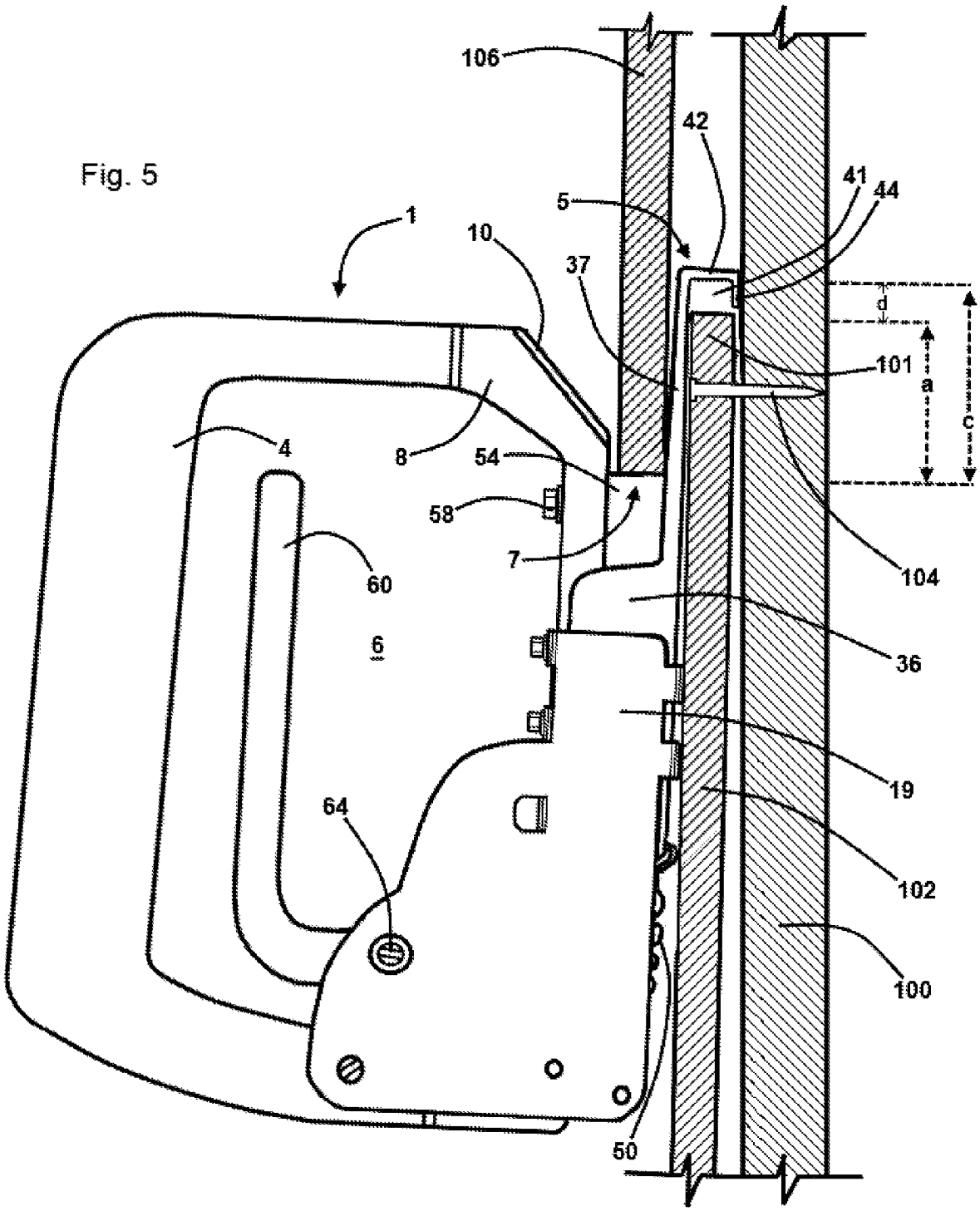
FIG. 5 redepicts FIG. 4, the view of FIG. 5 showing actuation of the tool's "S" hook extending and retracting means.

Thereafter, referring simultaneously to all figures, the user, while manually grasping handle 4, may extend his or her fingers about lever 60, and may grasp and rearwardly depress such lever 60 causing the lever 60 to pivot in the counterclockwise direction about pivot pin 64. Such pin advantageously functions as a fulcrum which causes actuator arm 62 and its clevis 66 to drive upwardly against carry pins 48, slidably moving slide shaft 36 upwardly against the downwardly biasing spring 50. Accordingly, counter-clockwise pivoting movement of the lever 60 from the forward position depicted in FIG. 4, to the rearwardly retracted position depicted in FIG. 5, may advantageously drive the slide shaft 36 and its attached board top edge hooking means upwardly from the position depicted in FIG. 4 to the vertically displaced position depicted in FIG. 5. FIG. 5 represents movement of the slide shaft 19 to a tool releasing position, such position displacing the board top edge hooking means 5 a distance "c" away from the board bottom edge hooking means 7. The differential "d" between displacement "c" and displacement "a" preferably is at least as great as the vertical depth of the valley 41 which is formed by the board top edge hooking means 5. Such distance differential advantageously allows the bottom edge 107 of board 106 to be flexed or splayed rearwardly away from the upper end 101 of board 102, while the extreme lower end of tang 44 travels horizontally over and clears the extreme upper end of board 102. Following such horizontal motion of the tool 1 and board 106, the tool 1 may be easily and conveniently drawn downwardly and extracted from its position between the boards 102 and 106. Thereafter, the tool 1 may be further used for assistance in installation of successive overlying wall siding boards.

Multiple rendition of the tool 1 may be provided for suspending opposite horizontal ends of wall siding boards.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A wall siding board installation tool comprising:

(a) a quill and shaft assembly, said assembly's quill having an upper end and said assembly's shaft having an upper end;

(b) board top edge hooking means and board bottom edge hooking means, said means defining an "S" hook, the board top edge hooking means being fixedly attached to an upper end selected from the group consisting of the quill's upper end and the shaft's upper end, the board bottom edge hooking means being fixedly attached to the other upper end among said group; and (c) first "S" hook extending and retracting means connected operatively to the quill and shaft assembly, the first "S" hook extending and retracting means being adapted for moving the quill or the shaft between a board suspending position and a tool releasing position, the board top edge and board bottom edge hooking means being displaced a calibrated lap joint distance away from each other upon movement of the quill or the shaft to the board suspending position, the board top edge and board bottom edge hooking means being further displaced away from each other upon movement of the quill or the shaft to the tool releasing position.

2. The wall siding board installation tool of claim 1 further comprising biasing means operatively interconnecting the quill and the shaft, the biasing means being adapted for normally moving the quill or the shaft to the board suspending position.

3. The wall siding board installation tool of claim 2 wherein the biasing means comprises a spring.

4. The wall siding board installation tool of claim 3 wherein the first "S" hook extending and retracting means comprise a lever, pivot, and actuator arm assembly, the lever, pivot, and actuator arm assembly being operatively connected to the quill or to the shaft, the lever, pivot, and actuator arm assembly being adapted for moving the quill or the shaft toward the tool releasing position.

5. The wall siding board installation tool of claim 4 further comprising a handle fixedly attached to the quill or fixedly attached to the shaft, the handle being positioned for simultaneous manual grasping of the handle and of the first "S" hook extending and retracting means' lever.

6. The wall siding board installation tool of claim 5 further comprising second "S" hook extending and retracting means connected operatively to the quill or connected operatively to the shaft, the second "S" hook extending and retracting means being adapted for selective adjustment of the calibrated lap joint distance between the board top edge and board bottom edge hooking means.

7. The wall siding board installation tool of claim 6 wherein the second "S" hook extending and retracting means comprise a slide block and releasable slide block fastening means.

8. The wall siding board installation tool of claim 7 wherein the handle comprises an "O" frame having a forward "S" hook supporting end.

9. The wall siding board installation tool of claim 8 wherein the lever is positioned for finger gripping and finger actuated motion within the "O" frame.

10. The wall siding board installation tool of claim 9 wherein the "O" frame's forward "S" hook supporting end has an upper end, and further comprising a chamfered edge, the chamfered edge being positioned at said upper end, and the chamfered edge being adapted for guiding the board bottom edge into engagement with the board bottom edge hooking means.

11. The wall siding board installation tool of claim 10 wherein the board bottom edge hooking means comprise an upwardly opening valley, said valley having a floor.

12. The wall siding board installation tool of claim 11 wherein the slide block has an upper surface, the upwardly opening valley's floor comprising said upper surface.

13. The wall siding board installation tool of claim 12 wherein the board top edge hooking means comprise a downwardly opening valley, said valley having a depth.

14. The wall siding board installation tool of claim 13 wherein the displacement of the board top edge hooking means from the board bottom edge hooking means upon movement of the quill or the shaft to the tool releasing position exceeds said means' board suspending position displacement, such displacement excess being at least as great as the downwardly opening valley's depth.

* * * * *